US008502697B2

(12) United States Patent
Bushman

(10) Patent No.: US 8,502,697 B2
(45) Date of Patent: Aug. 6, 2013

(54) MID-BLOCK TRAFFIC DETECTION AND SIGNAL CONTROL

(75) Inventor: Robert J. Bushman, Hepburn (CA)

(73) Assignee: International Road Dynamics Inc., Saskatoon, Saskatchewan (CA)

( * ) Notice: Subject to any disclaimer, the term of this patent is extended or adjusted under 35 U.S.C. 154(b) by 145 days.

(21) Appl. No.: 12/338,961

(22) Filed: Dec. 18, 2008

(65) Prior Publication Data

US 2009/0284395 A1 Nov. 19, 2009

Related U.S. Application Data

(60) Provisional application No. 61/045,470, filed on Apr. 16, 2008.

(51) Int. Cl.
*G08G 1/07* (2006.01)

(52) U.S. Cl.
USPC ..... 340/923; 340/907; 340/917; 340/918

(58) Field of Classification Search
USPC ..... 340/907, 916–921, 910, 911, 923
See application file for complete search history.

(56) References Cited

U.S. PATENT DOCUMENTS

| | | | | |
|---|---|---|---|---|
| 4,750,129 | A * | 6/1988 | Hengstmengel et al. | 701/117 |
| 4,914,434 | A * | 4/1990 | Morgan et al. | 340/906 |
| 5,172,113 | A * | 12/1992 | Hamer | 340/907 |
| 5,173,692 | A * | 12/1992 | Shapiro et al. | 340/943 |
| 5,617,086 | A * | 4/1997 | Klashinsky et al. | 340/907 |
| 5,673,039 | A * | 9/1997 | Pietzsch et al. | 340/905 |
| 5,777,564 | A * | 7/1998 | Jones | 340/917 |
| 6,281,808 | B1 * | 8/2001 | Glier et al. | 340/933 |
| 6,633,238 | B2 * | 10/2003 | Lemelson et al. | 340/909 |
| 7,082,879 | B2 * | 8/2006 | Alt | 104/88.01 |
| 2006/0181433 | A1 * | 8/2006 | Wolterman | 340/917 |

* cited by examiner

*Primary Examiner* — Mohammad Ghayour
*Assistant Examiner* — Nay Tun
(74) *Attorney, Agent, or Firm* — Nixon & Vanderhye P.C.

(57) ABSTRACT

A method and system for a mid-block traffic detection and traffic signal control system is provided herein that is suited to monitoring heavy commercial vehicles such as trucks is provided. The method comprises detecting a vehicle and determining at least one pre-determined parameter of the vehicle. A traffic condition is evaluated based on the at least one pre-determined parameter. In response to the evaluation of the traffic condition, a traffic signal is controlled.

6 Claims, 12 Drawing Sheets

MID-BLOCK TRAFFIC DETECTION AND SIGNAL CONTROL

CROSS-REFERENCE TO RELATED APPLICATION

This application claims the benefit of U.S. provisional application Ser. No. 61/045,470 filed Apr. 16, 2008 entitled "Mid-block Traffic Detection and Signal Controller", the entire contents of which are expressly incorporated by reference herein.

FIELD

The present invention relates generally to traffic detection and traffic signal control. More particularly, the present invention relates to mid-block detection of commercial vehicles and traffic signal control for regulation of traffic.

BACKGROUND

Transportation is one of the leading drivers of the world economy. In particular, road freight transportation plays a major role in movement of processed and unprocessed goods. Moreover, the use of heavy vehicles capable of handling increased loads provides improved economic benefits. Movement of commercial vehicles within urban areas is a very significant aspect in the overall freight path. Consequently, commercial vehicles are a substantial contributor to traffic congestion, road safety, increased wear and tear; and lead to negative environmental impacts in urban areas.

Conventional traffic management systems in urban areas are predominantly planned and designed for the effective control of passenger vehicles. Heavy commercial vehicles (HCVs), are generally much larger in size, and have different operating capabilities than passenger vehicles. For example, HCVs typically have greater stopping distances, longer acceleration times and larger turning radius. Traffic signal systems and controls in urban areas do not generally account for these differences and inherently lead to negative impacts on other road users.

SUMMARY OF DISCLOSED EMBODIMENTS

In a first aspect, a method is provided for mid-block detection of vehicles comprising detecting a vehicle in a traffic lane; determining at least one pre-determined parameter of the vehicle; evaluating a traffic condition based on the at least one predetermined parameter; and controlling a traffic signal in response to the evaluation of the traffic condition.

In one feature of this method, the at least one pre-determined parameter is one of the following, namely, vehicle speed, vehicle length, vehicle weights; vehicle axle spacings; vehicle number of axles; and time and date of detection of a vehicle.

In another feature of this method a pre-determined traffic signal is controlled in response to a plurality of detected vehicle parameters.

Generally, a method and a system are provided for mid-block traffic detection and traffic signal control that is suited to monitoring heavy commercial vehicles, such as trucks. The method comprises detecting a vehicle and determining at least one predetermined parameter of the vehicle. A traffic condition is evaluated based on the at least one pre-determined parameter. In response to the evaluation of the traffic condition, a traffic signal is controlled.

In further aspect, a system is provided for mid-block detection of vehicles comprising a sensor for detecting a vehicle in a traffic lane; a processor for determining at least one predetermined parameter of the vehicle and for evaluating a traffic condition based on the at least one pre-determined parameter, the processor controlling a traffic signal in response to the evaluation of the traffic condition.

In one feature of this system the at least one pre-determined parameter is one of the following: vehicle speed; vehicle length; vehicle axle weights; vehicle axle spacings; vehicle number of axles; and time and date of detection of a vehicle.

In an aspect, the system for mid-block detection of vehicles comprises a sensor for detecting a vehicle and a processor for determining at least one pre-determined parameter of the vehicle. The processor evaluates a traffic condition based on the at least one pre-determined parameter and controls a traffic signal in response to the evaluation of the traffic condition.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

As discussed earlier, conventional traffic management systems in urban areas are predominantly planned and designed for the effective control of passenger vehicles (PCVs), having different operating capabilities than passenger vehicles, are not efficiently monitored and controlled by conventional systems. The conventional traffic signal systems and controls in urban areas do not generally account for the differences in operating capabilities of PCV's resulting in hazardous conditions.

Accordingly, embodiments described herein provide a method and system for mid-block detection of heavy commercial vehicles and signal control for regulation of traffic.

As used herein, a "heavy commercial vehicle" refers to cargo trucks, semitrucks, B-Doubles, Road-Trains, and other large sized trucks collectively known as multi-combination vehicles (MCV).

The pre-determined parameters can include, among others, vehicle speed. vehicle lengths axle spacing, number of axles, weather conditions, road or intersection characteristics, and time and date of vehicle detection etc. The pre-determined parameters are recorded and an evaluation of the traffic condition is performed. In response, to the evaluation of the traffic condition or upon determination of behavior triggering conditions being satisfied, one or more traffic signals are controlled.

Furthermore, in case of an error in the detection of the vehicle, an error detection log can be created for performance evaluation and maintenance purposes.

Figure 1:
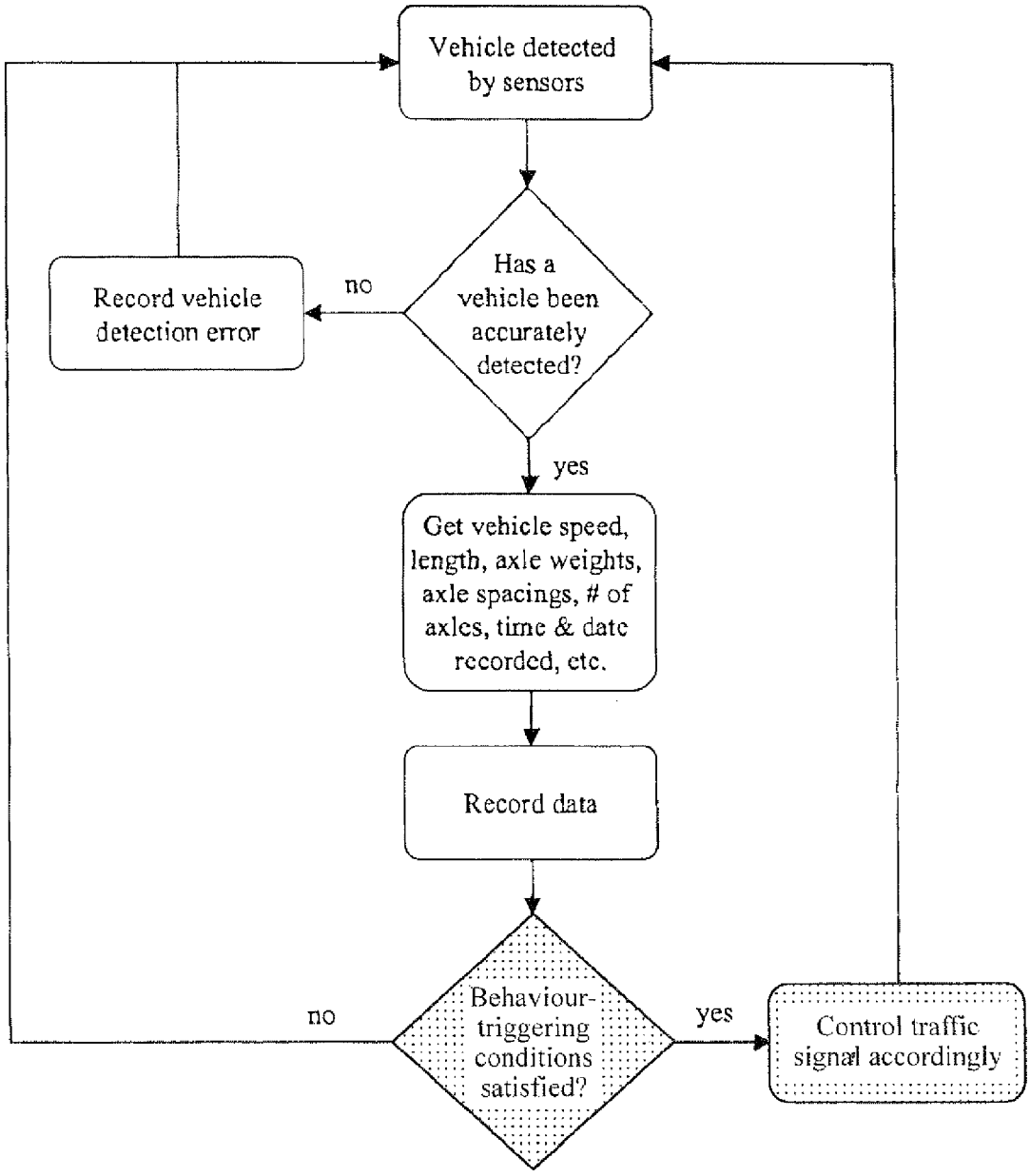
FIG. 1 is a flow diagram illustrating a method for controlling traffic in accordance with an embodiment.

In an exemplary embodiment, as shown in FIG. 1, the system observes unsafe or sub-optimal traffic situations, and responds to them by appropriately controlling the traffic signal. The exemplary system is designed to detect trucks and operating characteristics of trucks prior to entry or approach to a traffic intersection, such as at mid-block. Many conventional systems do not discern trucks from the other vehicles in the traffic stream. Since the operating characteristics of trucks differ greatly from automobile traffic, the detection can then be used as part of a larger logic process to modify the signal timing and phases to both enhance the movement of truck traffic, and prevent dangerous situations that trucks may be exposed to as a result of the traffic signals not accommodating the unique nature of the truck traffic.

The exemplary embodiment is discussed in further detail in the following exemplary scenarios.

Example 1

Figure 2:
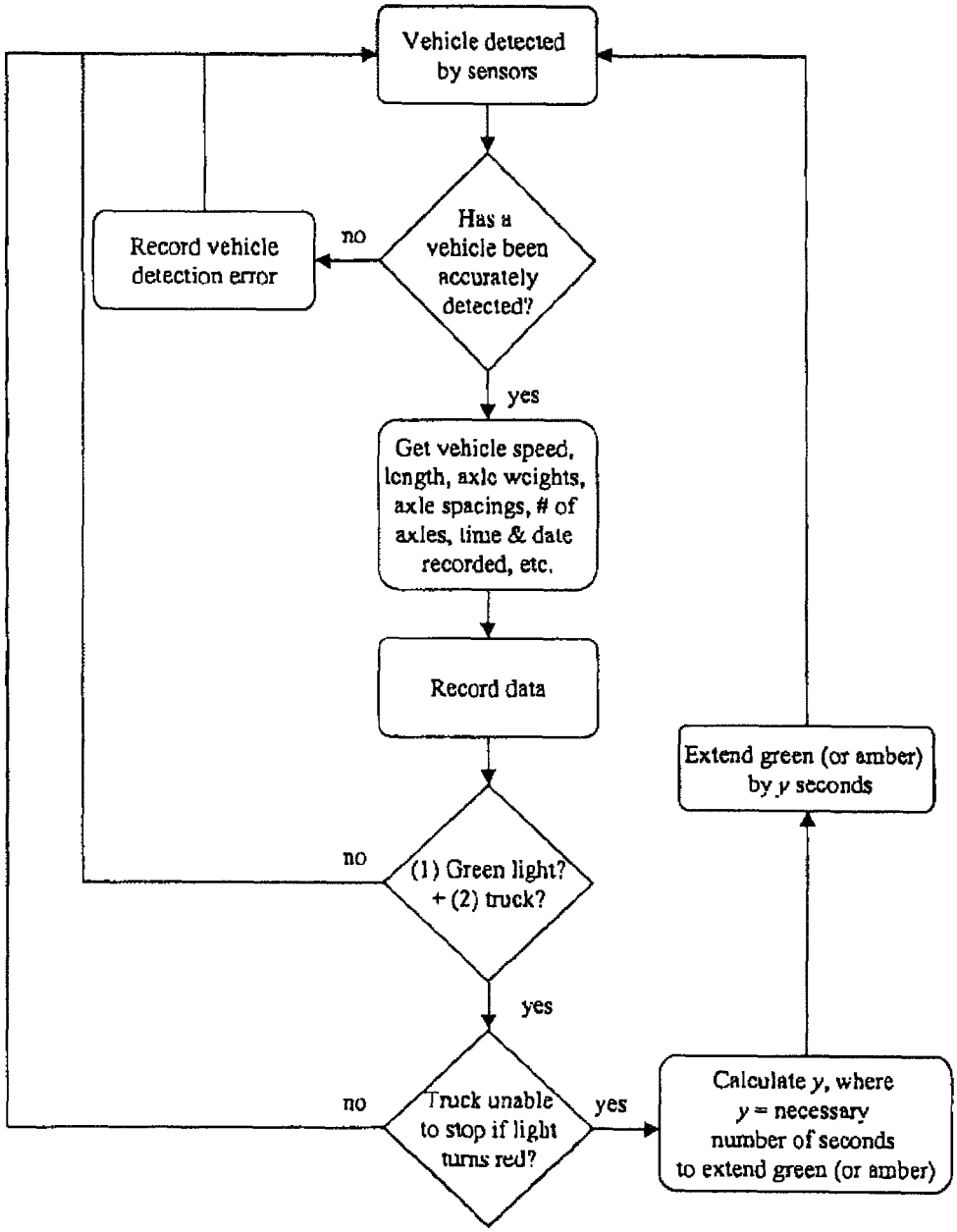
FIG. 2 is a flow diagram illustrating an example of the method for traffic control in accordance with the embodiment of FIG. 1.

An HCV is behind a long trail of cars waiting for a traffic signal to turn green. The signal changes to green, but the slope of the road and the heavy load prevent the HCV from accelerating quickly enough to reach the intersection before the traffic signal changes to red again. In an embodiment of the system, this situation is recognized by analyzing the characteristics of traffic approaching the traffic signal and detecting the presence of the HCV. Based on the evaluation of the traffic condition, the length of the green signal is extended to give the HCV enough time to traverse the traffic signal, thereby clearing the intersection and preventing a dangerous stopping situation for the truck. FIG. 2 is a flow diagram illustrating this scenario.

Example 2

Figure 3A:
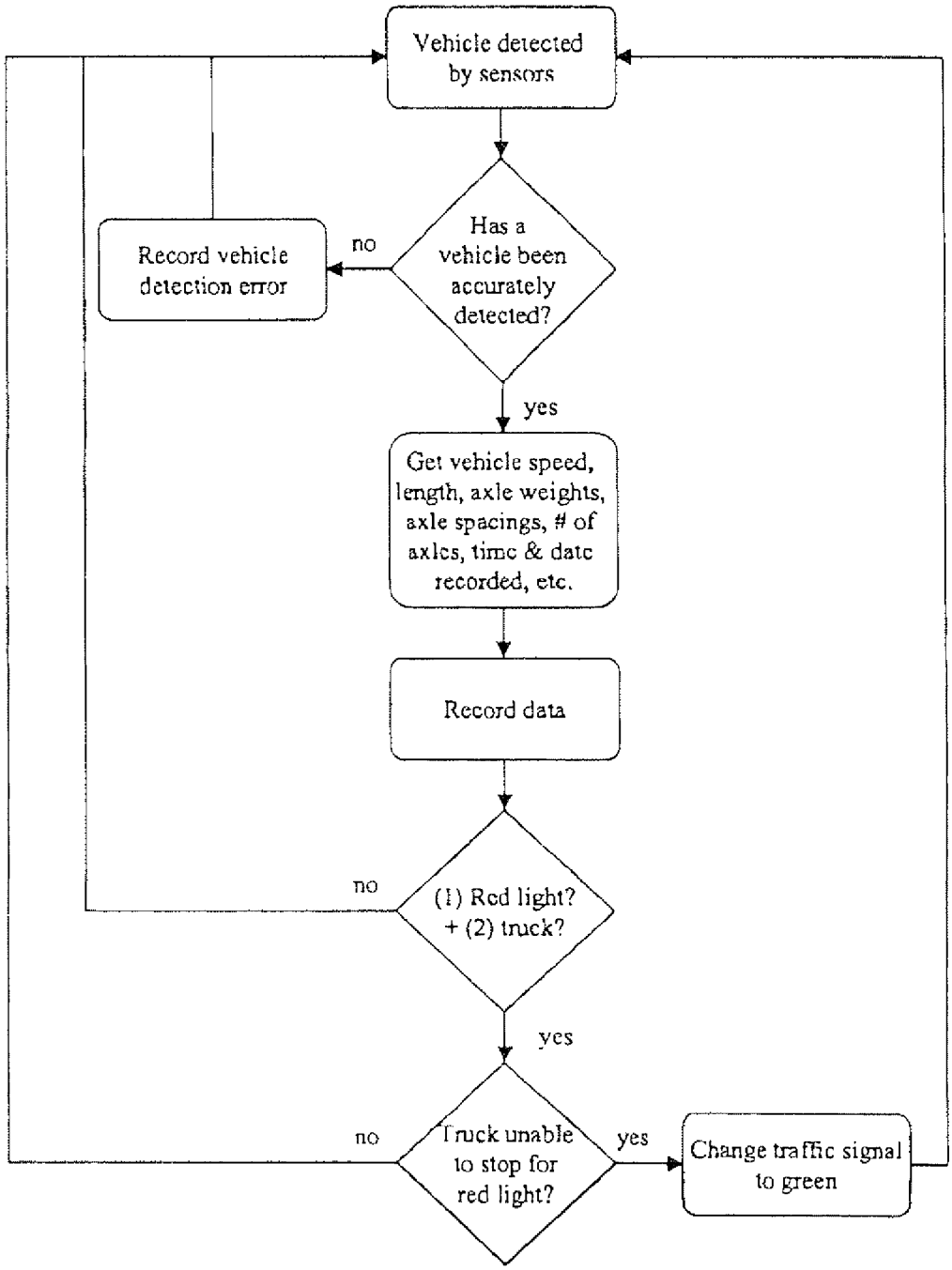
FIG. 3A is a flow diagram illustrating another example of the method for traffic control in accordance with the embodiment of FIG. 1.
Figure 3B:
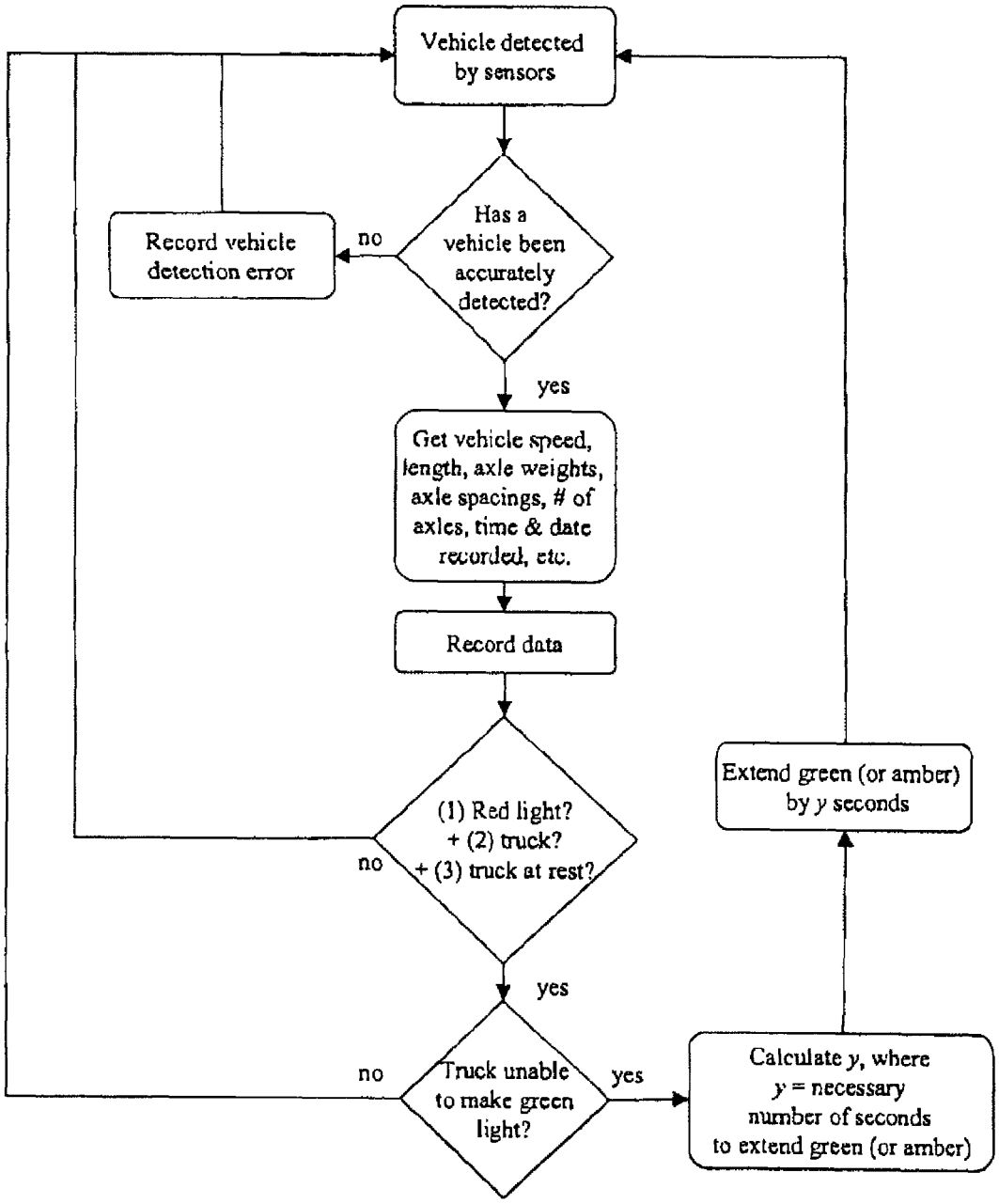
FIG. 3B is a flow diagram illustrating yet another example of the method for traffic control in accordance with the embodiment of FIG. 1.

A heavily loaded truck travelling at some speed approaches a red traffic signal. Due to its heavy load and configuration, the truck may be incapable of executing a safe stop at the red light. An embodiment of the system recognizes the presence of the truck and observes its mass, velocity, and its type. Based on this information, the system calculates whether the truck is able to stop, and if it cannot, the system changes the traffic signal to green phase to allow the safe passage of the traffic and thereby again reducing conflicts. This exemplary scenario is illustrated in FIG. 3B Example 3

A semi-truck traveling at a high speed approaches a green traffic signal. Due to its heavy load and configuration, the semi-truck may be incapable of executing a safe stop if the light were to turn red. An embodiment of the system detects the presence of the truck and determines its mass, velocity, and its type. Based on this information, the system evaluates whether the truck is able to stop. In the event the system determines that the semi-truck cannot stop, the system calculates the amount of time required for the safe passage of the semi-truck. The system then extends the green and/or amber phase to allow the safe passage of the traffic and thereby again reducing conflicts. FIG. 3B is a flow diagram illustrating this scenario.

Figure 4:
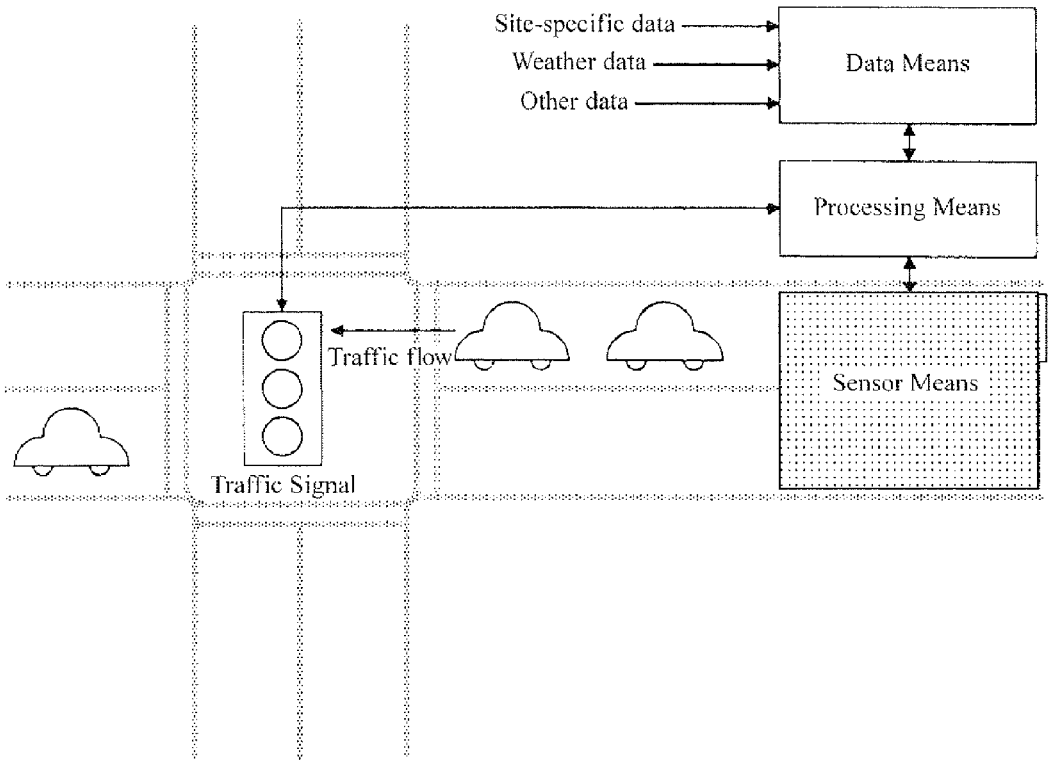
FIG. 4 is a system for mid-block detection and traffic control in accordance with an embodiment.

FIG. 4 is an exemplary embodiment of the system for mid-block detection and traffic control. As shown in FIG. 4, one or more sensors are disposed in a traffic lane, or a plurality of traffic lanes, approaching a traffic signal. The sensors provide signals to the processor dependant on one or more parameters of traffic traversing the sensors. The sensors are capable of providing signals for distinguishing between general traffic (for example, passenger vehicles) and HCVs (for example, large trucks).

In addition, data storage having site-specific data, weather data, and other data logs stored therein can communicate with the processor. The data storage can be updated by the processor and/or other suitable external data feeds, as shown in FIG. 4.

Figure 5:
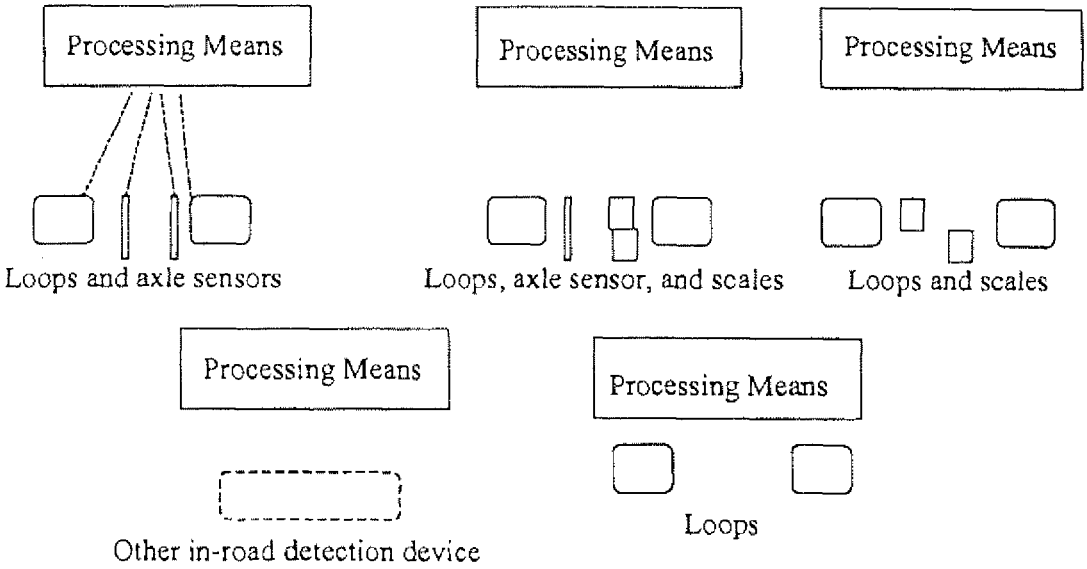
FIG. 5 is an illustration of various sensors for in-road detection used in an embodiment.

Various sensors can be used in conjunction with the embodiments of the system as shown in FIG. 5. For example, in-road sensors with capabilities of determining vehicle length can be used. Additionally, the sensors may be capable of determining one or more of: the number of axles, spacing between axles, weight of the axles, speed of the vehicle, and potentially the external dimensions of the vehicle. In-road sensors could use one or more existing or still to be developed technologies including inductive loops, magnetic detection sensors, piezoelectric axle sensors, quartz axle sensors, bending plate scales, or load cell scales. The sensors may also be capable of measuring the vehicle acceleration or deceleration.

Figure 6:
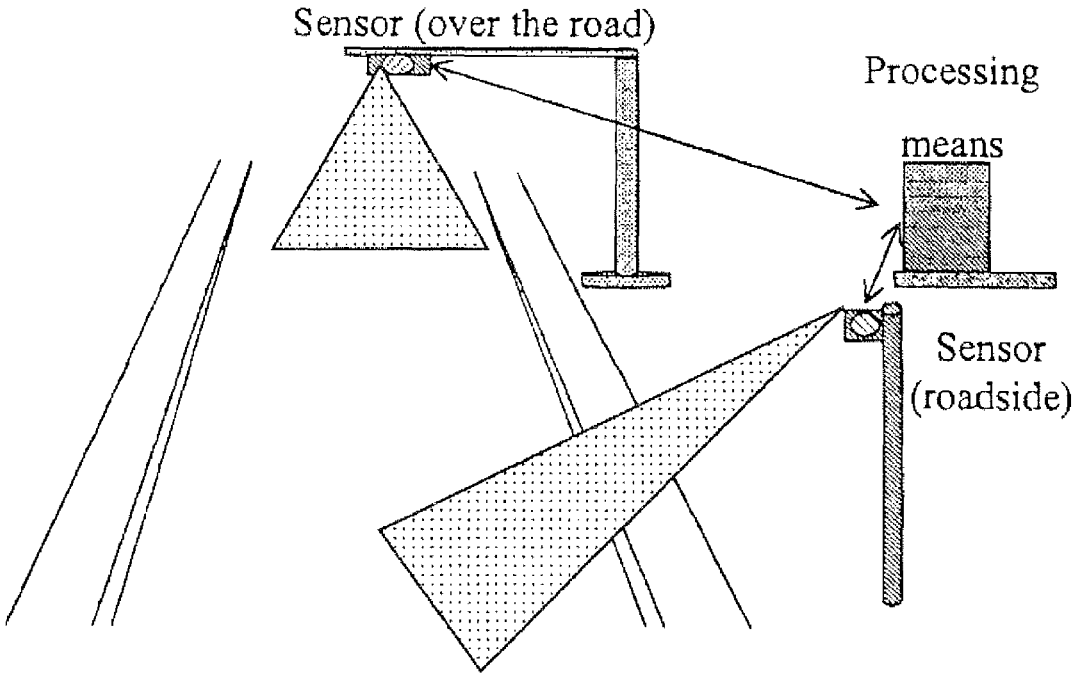
FIG. 6 is an illustration of non-intrusive detection devices used in an embodiment.

In other embodiments, non-intrusive sensors mounted adjacent to the road using radar, acoustic, laser, video or other means to characterize vehicle types as shown in FIG. 6. The non-intrusive sensors can communicate with the processors through various wired and wireless communication systems.

Figure 7A:
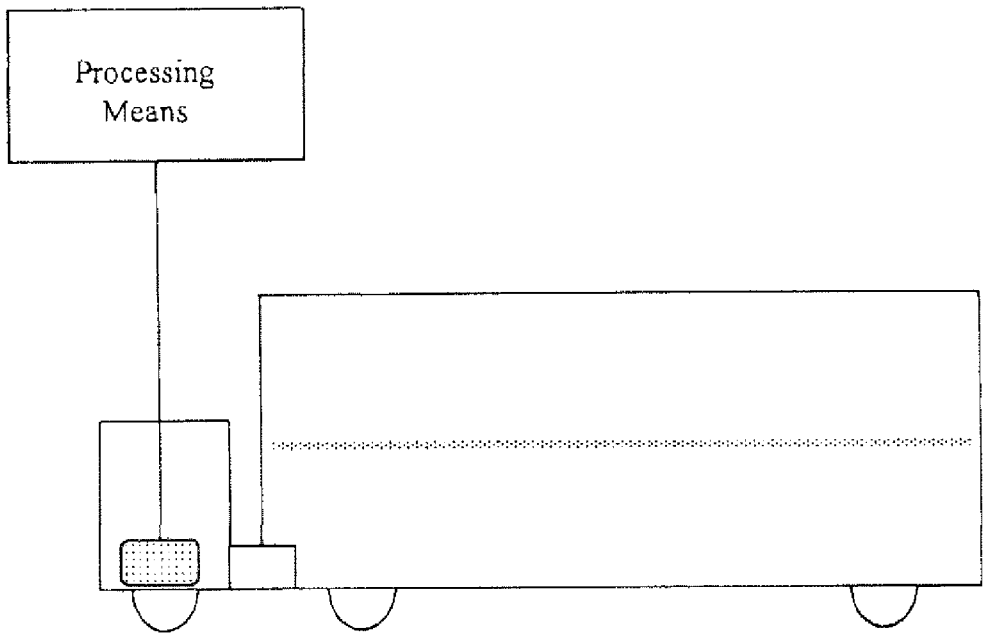
FIGS. 7A-C are illustrations of on-board identification devices used in an embodiment.
Figure 7B:
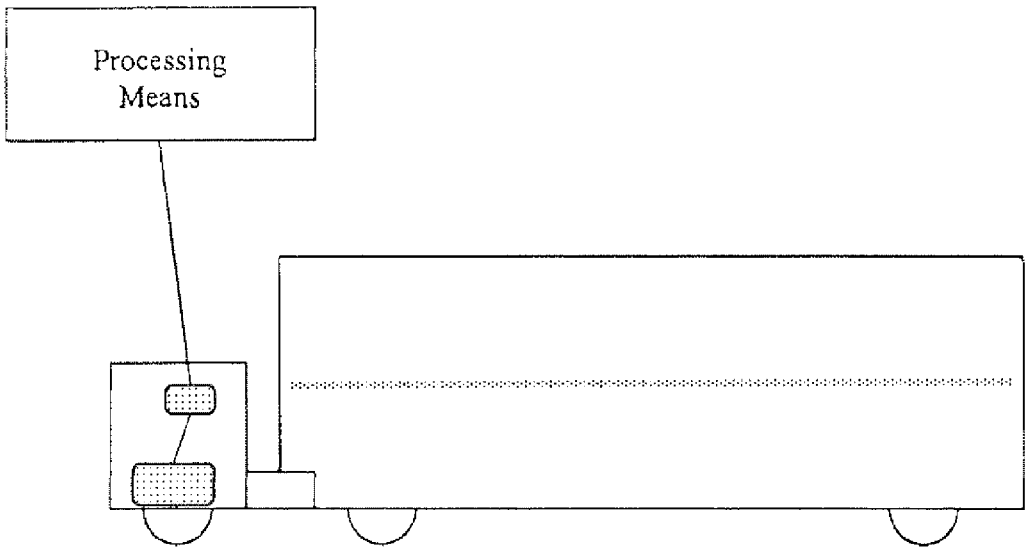
Figure 7C:
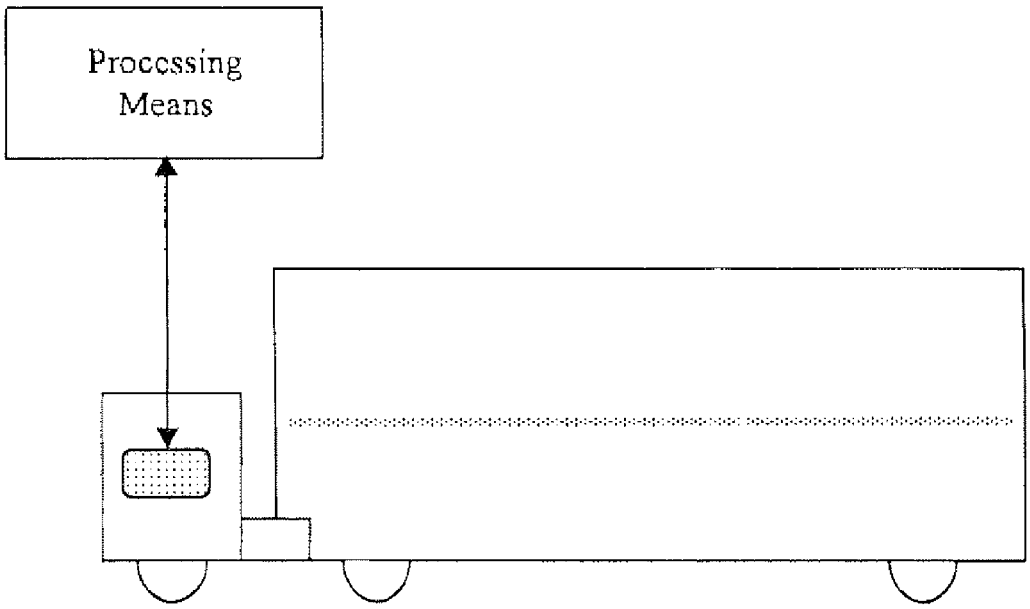

Further embodiments of the system can include communication with a device located on the vehicle to transmit vehicle specific information, such as vehicle identification, vehicle type, or other specific vehicle characteristics such as weight. Vehicle specific information may be obtained directly from the vehicle on-board computer (for example, GANBUS J1939) as shown in FIG. 7A, from the vehicle on-board computer via an external communication/processing device as shown in FIG. 7B, or an identification device added to the vehicle, such as a transponder as shown in FIG. 7G.

The processor uses data from the data storage and signals from the sensors means to compute a traffic control signal that controls the traffic signal device. The processor determines various characteristics of vehicle such as speed and acceleration/deceleration, and the appropriate action of the traffic signal device.

Figure 8A:
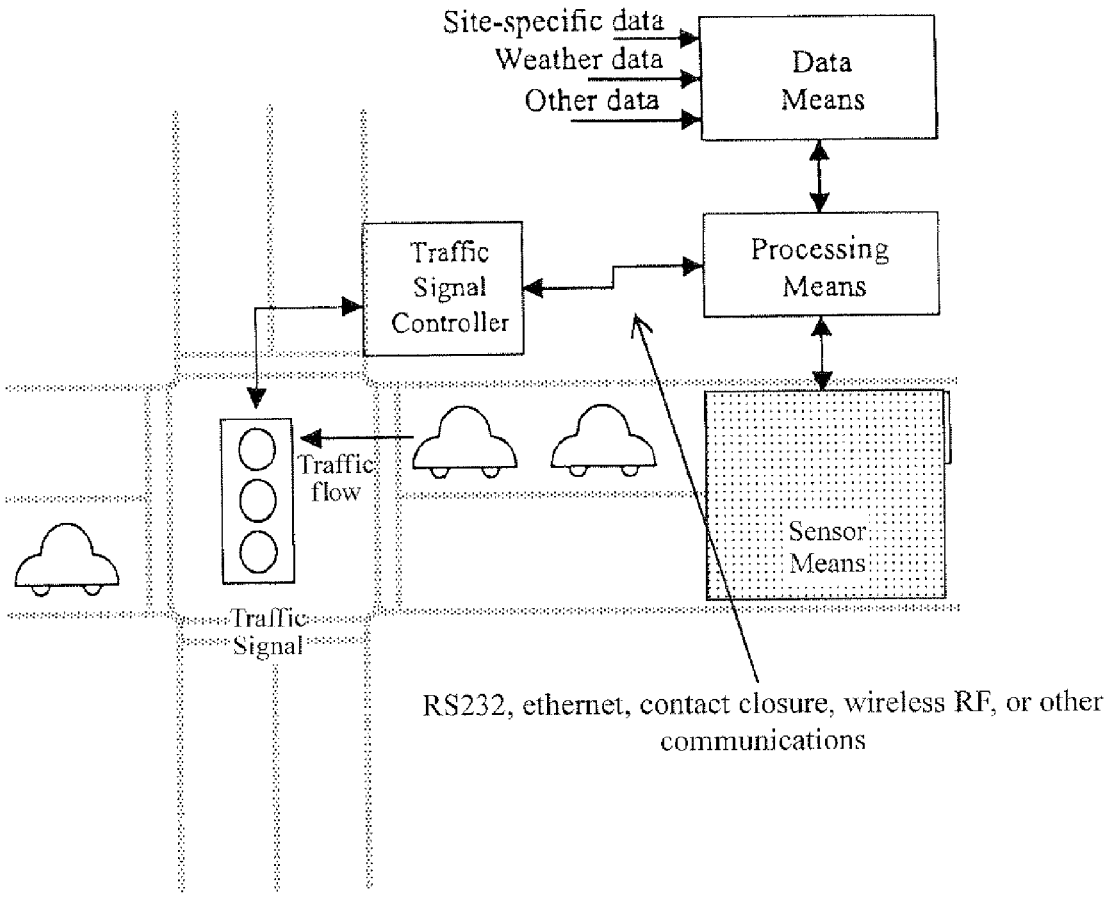
FIG. 8A is a system for mid-block detection and traffic control in accordance with an embodiment.
Figure 8B:
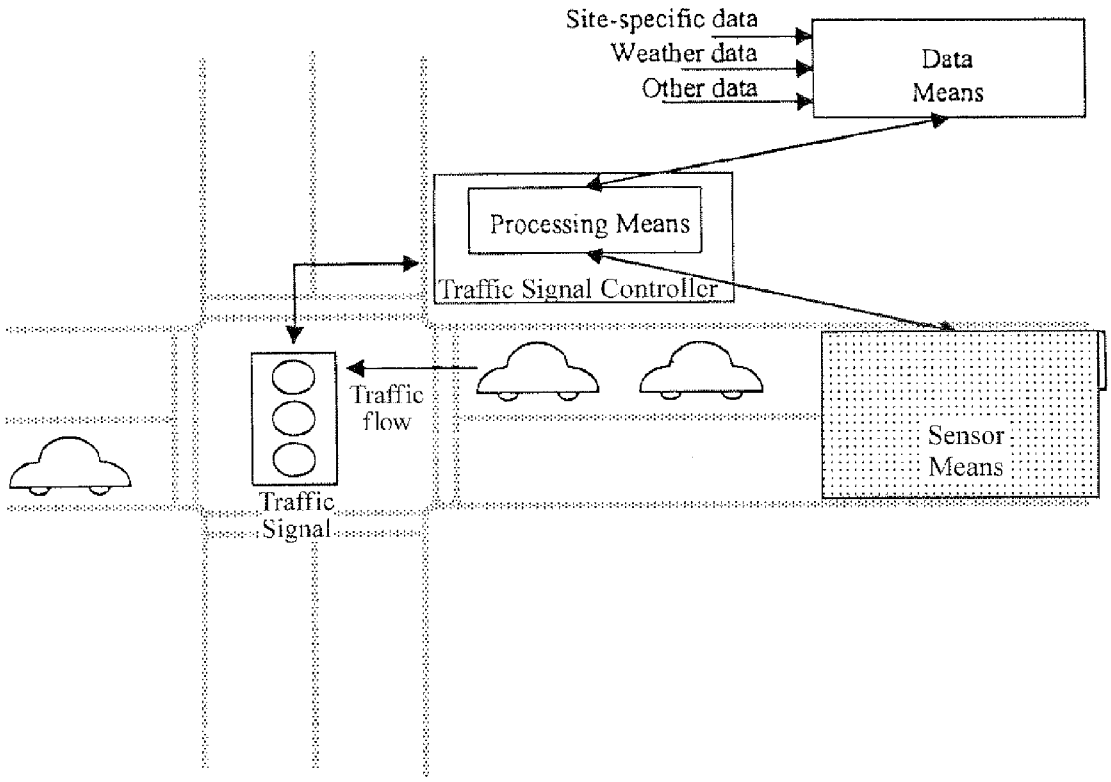
FIG. 8B is a system for mid-block detection and traffic control in accordance with an embodiment.

The processor may be a separate processing unit that processes and communicates with the traffic signal controller via RS232, Ethernet, wireless RF, contact closure or other appropriate communication method as shown in FIG. 8A. Alternately, processing means may be contained as part of or added to traffic signal controller as shown in FIG. 5.

Embodiments of the system are connected to a traffic signal device associated with the traffic lane, or plurality of traffic lanes, and disposed downstream from the sensors.

Generally, the system controls the traffic signal device(s) downstream to facilitate management of HCV traffic. As noted above, the system can adjust the traffic signals to accommodate heavy trucks in the traffic pattern that cannot easily accelerate along with the automobile traffic, or stop as efficiently as the automobiles. For example, the system can extend the duration of green phases for stopped trucks that are fully loaded; lengthen the yellow phases, or increase the all-red, or non-dilemma red phases.

An exemplary situation that will trigger the system to manage the traffic control in accordance with an embodiment is described below. As described with respect to FIG. 3B, a fully loaded truck is at rest at a distance X meters from a traffic signal. Under routine duration of a green phase of the traffic signal, the truck may not be able to safely traverse the traffic signal due to the truck's load and operating parameters. This situation can pose a potential traffic congestion problem or even a traffic hazard. The system can detect this situation and according adjust the duration of the green phase in order to accommodate the truck by detecting the presence of the truck in the traffic approaching the intersection controlled by the traffic signal. The sensors detect the presence of the truck and communicate a number of pre-determined characteristics of the truck to the processor. The processor analyses this information and outputs control signals to the traffic controller to extend the duration of the green phase in real-time thereby providing a safe passage for the truck.

Typically, a number of pre-determined parameters comprise are collected by the sensors and communicated to the detector for the evaluation of circumstances that require the intervention of the system in order to manage the traffic controller. The information evaluated by the processor from the parameter data supplied by the sensors can include, for example, current status of traffic signal; weight of a vehicle; axle length of the vehicle; and velocity of the vehicle etc. The system can also detect the number of vehicles; weight of the vehicles; velocity of vehicles; and length of vehicles and the like.

The parameters that are sensed and monitored can be adjusted based on the requirements of a particular traffic pattern, site-specific information etc. In most circumstances, a configuration of the vehicle (number and inter-relationships of the axles), weight of the vehicle, and speed will enable the system to compute safe stopping distances based on the site geometry. Using this data, a database table of results can be established, giving the course of action for several different scenarios. For example, based on the type of the HCV and the speed computed, a "cannot stop", "may be able to stop", and "no problem" set of scenarios can be established. A course of action dependent upon each of these scenarios can then be set in motion by the processor through the traffic controller. The course of action can be, for example, extending the green and yellow in a "cannot stop" scenario, while no action needs to be taken in a "no problem" scenario.

Under most traffic conditions, a traffic signal communicates a current state to the processor and the in-road or non-intrusive sensors, such as weight sensors, axle length sensors, velocity sensors and means of sensing number of vehicles, can provide information to the processor in real time. As noted above, based on this information the processor can evaluate the characteristics of an HCV present in the traffic. Furthermore, the processor can receive additional information on the traffic flow at any given time along with other relevant information such as weather data from a suitable database. The system evaluates different traffic scenarios and accordingly controls the traffic controller. For example, if there is very low traffic, then the system would respond differently than if there was a much higher level of traffic. The system therefore has not only the speed/configuration scenarios as indicated above, but different tables of results (or courses of action) depending on traffic conditions. Thus, the system can adaptively control traffic under various traffic conditions.

In summary, embodiments of the system described herein are capable of observing unsafe or sub-optimal traffic situations, and respond to them by appropriately controlling the traffic signal thereby preventing hazardous conditions and reducing the negative impact of HCVs on other road users.

In the preceding description, for purposes of explanation, numerous details are set forth in order to provide a thorough understanding of the embodiments of the invention. However, it will be apparent to one skilled in the art that these specific details are not required in order to practice the invention. In other instances, well-known electrical structures and circuits are shown in block diagram form in order not to obscure the invention. For example, specific details are not provided as to whether the embodiments of the invention described herein are implemented as a software routine, hardware circuit, firmware, or a combination thereof.

Embodiments of the invention can be represented as a software product stored in a machine-readable medium (also referred to as a computer-readable medium, a processor-readable medium, or a computer usable medium having a computer-readable program code embodied therein). The machine-readable medium can be any suitable tangible medium, including magnetic, optical, or electrical storage medium including a diskette, compact disk read only memory (CD-ROM), memory device (volatile or nonvolatile), or similar storage mechanism. The machine-readable medium can contain various sets of instructions, code sequences, configuration information, or other data, which, when executed, cause a processor to perform steps in a method according to an embodiment of the invention. Those of ordinary skill in the art will appreciate that other instructions and operations necessary to implement the described invention can also be stored on the machine-readable medium. Software running from the machine-readable medium can interface with circuitry to perform the described tasks.

The above-described embodiments of the invention are intended to be examples only, Alterations, modifications and variations can be effected to the particular embodiments by those of skill in the art without departing from the scope of the invention, which is defined solely by the claims appended hereto.

The invention claimed is:

1. A method for detection of vehicles at a mid-block approaching a traffic-signal-controlled intersection, comprising:

(a) operating sensors to detect a vehicle on a traffic lane;

(b) inputting intersection data to a processor, the intersection data including intersection traffic flow conditions, intersection site-specific conditions and intersection weather conditions;

(c) determining predetermined parameters of a heavy commercial vehicle (HCV) from the sensors;

(d) recording data of the predetermined parameters of the HCV;

(e) determining from an output of the sensors if the vehicle detected thereby is either a car or a HCV, and only if the detected vehicle is a HCV, then (f) determining if the traffic signal at the intersection is in a red phase, green phase or amber phase;

(g) determining whether behavior conditions for the HCV for safely traversing the intersection have been satisfied by evaluating a traffic condition based on speed of the HCV, at least one of the predetermined parameters of the HCV and the intersection data; and (h) operating the processor to control the traffic signal at the intersection in response to the evaluation of the traffic condition and the phase of the traffic signal to enable the HCV safely to traverse the intersection, wherein in the event the traffic signal at the intersection is in a green phase or an amber phase, then operating the processor to calculate a time "y" in seconds to extend the green phase or the amber phase of the traffic signal necessary for the HCV safely to traverse the intersection, and extending the green phase or the amber phase of the traffic signal by the calculated time "y", and wherein step (h) includes, (h1) determining if the HCV is at rest at a distance "X" from the traffic signal when the traffic signal is in a red phase, (h2) determining whether the HCV is able safely to traverse the intersection during a routine duration of the green phase of the traffic signal based on the distance "X" from which the HCV is at rest from the traffic signal and at least one of the pre-determined parameters of the HCV, and (h3) in the event the HCV is unable safely to traverse the intersection during the green phase of the traffic signal, then calculating the time "y" in seconds to extend the green phase of the traffic signal necessary for the HCV safely to traverse the intersection, and extending the green phase of the traffic signal by the time "y".

2. The method of claim 1, wherein the predetermined parameters comprise at least vehicle speed, vehicle length, vehicle weights; vehicle axle spacings; vehicle number of axles; and time and date of detection of a vehicle.

3. The method of claim 2, wherein the traffic signal is controlled in response to a plurality of detected vehicle parameters.

4. A system for detection of vehicles at a mid-block approaching a traffic-signal-controlled intersection comprising:

(a) a traffic signal located at the intersection, the traffic signal having selectable red, green and amber phases;

(b) a sensor for detecting a vehicle in a traffic lane and for determining if the detected vehicle; which is detected thereby, is either a car or a heavy commercial vehicle (HCV); and (c) a processor operatively connected to the sensor and to the traffic signal, the processor comprising downloaded intersection data including intersection traffic flow conditions, intersection site-specific conditions and intersection weather conditions, wherein (d) the processor is structured to determine predetermined parameters of the HCV from the sensor and is structured to evaluate a traffic condition based on the speed of the HCV, at least one of the predetermined parameters thereof and of the intersection data; and wherein (e) the processor is structured to control the traffic signal at the intersection and the phase of the traffic signal to enable the HCV safely to traverse the intersection, wherein in the event that the traffic signal at the intersection is in a green phase or an amber phase; the processor is structured first to calculate a time "y" in seconds to extend the green phase of the traffic signal or the amber phase of the traffic signal for a time in seconds, which is necessary for the HCV safely to traverse the intersection and then, after such calculation the processor is structured to extend the green phase of the traffic signal or the amber phase of the traffic signal for the time "y" in seconds, which is necessary for the HCV safely to traverse the intersection, and wherein the processor is further structured to (i) determine if the HCV is at rest at a distance "x" from the traffic signal when the traffic signal is in a red phase;

(ii) determine whether the HCV is able safely to traverse the intersection during a routine duration of the green phase of the traffic signal based on the distance "x" from which the HCV is at rest from the traffic signal and at least one of the predetermined parameters of the HCV; and (iii) in the event that the HCV is unable safely to traverse the intersection during the green phase of the traffic signal, then the processor is structured to calculate the time "y" in seconds which would be necessary to extend the green phase of the traffic signal for a time which is necessary for the HCV safely to traverse the intersection and then to extend the green phase or the amber phase, by the calculated time "y" in seconds, thereby allowing the HCV safely to traverse the intersection.

5. The system of claim 4, wherein the predetermined parameters comprise at least one of vehicle speed, vehicle length, vehicle weight, vehicle axle spacing, vehicle number of axles, and the time and date of detection of the vehicle.

6. The system of claim 5, wherein the processor is structure structured to control the traffic signal in response to a plurality of detected vehicle parameters.

* * * * *